US007352343B2

(12) United States Patent
Park

(10) Patent No.: US 7,352,343 B2
(45) Date of Patent: Apr. 1, 2008

(54) ENERGY RECOVERING APPARATUS AND METHOD FOR PLASMA DISPLAY PANEL

(75) Inventor: Joong Seo Park, Daegu-kwangyeokshi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/743,284

(22) Filed: Dec. 23, 2003

(65) Prior Publication Data

US 2004/0212316 A1 Oct. 28, 2004

(30) Foreign Application Priority Data

Apr. 23, 2003 (KR) ..... 10-2003-0025776

(51) Int. Cl.
*G09G 3/28* (2006.01)
*G09G 37/00* (2006.01)

(52) U.S. Cl. ..... 345/62; 315/169.3

(58) Field of Classification Search ..... 315/169.1, 315/169.3, 169.4; 345/60, 62, 66, 68
See application file for complete search history.

(56) References Cited

U.S. PATENT DOCUMENTS

| | | | | |
|---|---|---|---|---|
| 3,780,339 | A | 12/1973 | Mayle | 315/275 D |
| 4,070,663 | A | 1/1978 | Katani et al. | 340/324 |
| 4,707,692 | A | 11/1987 | Higgins et al. | 340/811 |
| 4,866,349 | A | 9/1989 | Weber et al. | 315/169.4 |
| 5,081,400 | A | 1/1992 | Weber et al. | 315/169.4 |
| 5,670,974 | A | 9/1997 | Ohba et al. | 345/60 |
| 6,175,192 | B1 * | 1/2001 | Moon | 315/169.3 |
| 6,680,581 | B2 * | 1/2004 | Lee et al. | 315/169.3 |
| 6,768,270 | B2 * | 7/2004 | Chae | 315/169.3 |
| 6,778,153 | B2 * | 8/2004 | Kang | 345/60 |
| 2003/0193450 | A1 * | 10/2003 | Lee et al. | 345/60 |
| 2004/0001290 | A1 * | 1/2004 | Yoon et al. | 361/15 |

* cited by examiner

*Primary Examiner*—Shih-Chao Chen
*Assistant Examiner*—Minh Dieu A
(74) *Attorney, Agent, or Firm*—Ked & Associates, LLP

(57) ABSTRACT

An energy recovering apparatus and method for a plasma display panel wherein a charge time of the plasma display panel can be shortened with the aid of a compulsory resonance to thereby improve a discharge characteristic. In the apparatus, a first path charges an inductor using energy from a source capacitor. A second path is separated from the source capacitor to supply energy of the inductor to the plasma display panel.

22 Claims, 15 Drawing Sheets

ENERGY RECOVERING APPARATUS AND METHOD FOR PLASMA DISPLAY PANEL

BACKGROUND OF THE INVENTION

1. Field of the Invention

This invention relates to an energy recovering apparatus and method for a plasma display panel, and more particularly to an energy recovering apparatus and method for a plasma display panel wherein a charge time of the plasma display panel can be shortened with the aid of a compulsory resonance to thereby improve a discharge characteristic.

2. Description of the Related Art

Recently, there has been developed various flat panel devices that are capable of reducing a heavy weight and a large bulk, which are drawbacks of the cathode ray tube (CRT). Such flat panel display devices include a liquid crystal display (LCD), a field emission display (FED), a plasma display panel (PDP) and an electro-luminescence display (ELD), etc.

The PDP of these flat panel display devices is a display device using a gas discharge, and has an advantage in that it is easy to manufacture a large-dimension panel. The PDP typically includes a three-electrode, alternating current (AC) surface discharge PDP that has three electrodes and is driven with an AC voltage as shown in FIG. 1.

Referring to FIG. 1, a discharge cell of the conventional three-electrode, AC surface-discharge PDP includes a first electrode 12Y and a second electrode 12Z provided on an upper substrate 10, and an address electrode 20X provided on a lower substrate 18.

On the upper substrate 10 provided with the first electrode 12Y and the second electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a fluorescent material 26. The address electrode 20X is formed in a direction crossing the first electrode 12Y and the second electrode 12Z. The barrier rib 24 is formed in parallel to the address electrode 20X to prevent an ultraviolet ray and a visible light generated by a discharge from being leaked to the adjacent discharge cells. The phosphorous material 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

Such a three-electrode, AC surface discharge PDP is driven with being separated into a number of sub-fields. In each sub-field interval, a light emission having a frequency proportional to a weighting value of a video data is conducted to provide a gray scale display. The sub-field is again divided into an initialization period, an address period, a sustain period and an erasure period.

Herein, the initialization period is a period for forming uniform wall charges on the discharge cell. The address period is a period for generating a selective address discharge in accordance with a logical value of the video data. The sustain period is a period for allowing a discharge cell in which the address discharge has been generated to sustain a discharge. The erasure period is a period for erasing a sustain discharge generated in the sustain period.

The address discharge and the sustain discharge of the AC surface-discharge PDP driven in the above manner requires a high voltage more than hundreds of volts. Accordingly, an energy recovering apparatus is used for the purpose of minimizing a driving power required for the address discharge and the sustain discharge. The energy recovering apparatus recovers a voltage between the first electrode 12Y and the second electrode 12Z, to thereby use the recovered voltage as a driving voltage upon the next discharge.

Referring to FIG. 2, energy recovering apparatus 30 and 32 of the PDP having been suggested by U.S. Pat. No. 5,081,400 of Weber are symmetrically arranged with respect to each other with having a panel capacitor Cp therebetween. The panel capacitor Cp is an equivalent expression of a capacitance formed between the first electrode Y and the second electrode Y. The first energy recovering apparatus 30 applies a sustain pulse to the first electrode Y. The second energy recovering apparatus 32 operates alternately with respect to the first energy recovering apparatus 30 to thereby apply a sustain pulse to the second electrode Z.

Hereinafter, configurations of conventional energy recovering apparatus of the PDP will be described with reference to the first energy recovering apparatus 30.

The first energy recovering apparatus 30 includes an inductor L connected between a panel capacitor Cp and a source capacitor Cs, first and third switches S1 and S3 connected, in parallel, between the source capacitor Cs and the inductor L, and second and fourth switches S2 and S4 connected, in parallel, between the panel capacitor Cp and the inductor L.

The second switch S2 is connected to a sustain voltage source VS while the fourth switch S4 is connected to a ground voltage source GND. The first to fourth switches S1 to S4 control a current flow.

The source capacitor Cs recovers and charges a voltage charged in the panel capacitor Cp upon sustain discharge and re-supply the charged voltage to the panel capacitor Cp. The source capacitor Cs is charged with a voltage Vs/2 equal to a half value of the sustain voltage source Vs.

The inductor L forms a natural resonance circuit along with the panel capacitor Cp. At this time, the conventional energy recovering apparatus allows a step of storing energy into the inductor L to overlap with a step of supplying the panel capacitor Cp with the energy stored in the inductor L.

Meanwhile, fifth and sixth diodes D5 and D6 provided between the first and second switches S1 and S2 and the inductor L, respectively prevent a current from flowing in a backward direction.

FIG. 3 is a timing diagram and a waveform diagram representing an on/off timing of switches in the first energy recovering apparatus and an output waveform of the panel capacitor.

An operation procedure of the energy recovering apparatus will be described assuming that 0 volt has been charged in the panel capacitor Cp and a Vs/2 voltage has been charged in the source capacitor Cs prior to a T1 interval.

In a T1 interval, the first switch S1 is turned on, to thereby form a current path extending from the source capacitor Cs, via the first switch S1, the inductor L, into the panel capacitor Cp. If the current path is formed, then a Vs/2voltage charged in the source capacitor Cs is applied to the panel capacitor Cp. At this time, a Vs voltage equal to twice the voltage of the source capacitor Cs is charged in the panel capacitor Cp because the inductor L and the panel capacitor Cs form a serial resonance circuit.

In a T2 interval, the second switch S2 is turned on. If the second switch S2 is turned on, then a voltage of the sustain voltage source Vs is applied to the first electrode Y. The voltage of the sustain voltage source Vs applied to the first electrode Y prevents a voltage Vcp of the panel capacitor Cp from falling into less than the sustain voltage source Vs to thereby cause a normal sustain discharge. Meanwhile, since the voltage Vcp of the panel capacitor Cp has risen into Vs in the T1 interval, a driving power supplied from the exterior for the purposing of causing the sustain discharge is minimized.

In a T3 interval, the first switch S1 is turned off. At this time, the first electrode Y sustains a voltage of the sustain voltage source Vs during the T3 interval. In a T4 interval, the second switch S2 is turned off while the third switch S3 is turned off. If the third switch S3 is turned off, then a current path extending from the panel capacitor Cp, via the inductor L and the third switch S3, into the source capacitor Cs is formed to recover a voltage Vcp charged in the panel capacitor Cp into the source capacitor Cs. At this time, a Vs/2voltage is charged in the source capacitor Cs.

In a T5 interval, the third switch S3 is turned while the fourth switch S4 is turned on. If the fourth switch S4 is turned on, then a current path between the panel capacitor Cp and the ground voltage source GND is formed, thereby allowing the voltage Vcp of the panel capacitor Cp to 0 volt. In a T6 interval, the T5 state is maintained during a certain time. In real, an alternating current driving pulse supplied to the first electrode Y and the second electrode Z allows the T1 to T6 intervals to be obtained with repeating periodically.

In the mean time, the second energy recovering apparatus 32 operates alternately with respect to the first energy recovering apparatus 30. Accordingly, a sustain pulse voltage Vs having a mutually contrary polarity is applied to the panel capacitor Cp. The sustain pulse voltage Vs having a mutually contrary polarity is applied to the panel capacitor Cp is applied, so that a sustain discharge can be generated from the discharge cells.

However, such conventional energy recovering apparatus 30 and 32 have a problem in that the first energy recovering apparatus 30 provided at the first electrode (Y) side and the second energy recovering apparatus 32 provided at the second electrode (Z) side operate individually to require many circuit elements such as a switching device, etc., and thus to raise a manufacturing cost. Furthermore, a lot of power consumption is caused by a conduction loss of a plurality of switches, such as a diode, a switch device and an inductor, etc., on the current path.

SUMMARY OF THE INVENTION

Accordingly, it is an object of the present invention to provide an energy recovering apparatus and method for a plasma display panel wherein a charge time of the plasma display panel can be shortened with the aid of a compulsory resonance to thereby improve a discharge characteristic.

In order to achieve these and other objects of the invention, an energy recovering apparatus of a plasma display panel according to one aspect of the present invention includes a first path for charging an inductor using energy from a source capacitor; and a second path, being separated from the source capacitor, for supplying energy of the inductor to the plasma display panel.

The energy recovering apparatus further includes a third path for charging a voltage from a sustain voltage source into the panel; a fourth path for recovering energy charged in the panel to charge the recovered energy, via the inductor, into the source capacitor; and a fifth path for charging a voltage from a ground voltage source into the panel.

Herein, the first path includes a first switching device connected between a second terminal of the source capacitor connected to a ground voltage source and a first terminal of the inductor; and a second switching device connected between a second terminal of the inductor and the ground voltage source.

The first and second switching devices keep a turned-on state during a period when energy from the source capacitor is charged in the inductor through the first path, and shut off the first path in a state in which energy has been charged in the inductor to thereby derive an inverse voltage into the inductor.

The second path includes a third switching device connected between the second terminal of the inductor and the panel; and a diode connected between a node positioned between the first terminal of the inductor and the first switching device and the ground voltage source to form a path for applying energy from the inductor to the panel.

The third switching device is turned on when the first and second switching devices are turned off, to thereby apply said inverse voltage derived into the inductor to the panel.

The third path includes a fourth switching device connected between the sustain voltage source and the panel.

The fourth path includes the first switching device and the third switching device.

Each of the second and fourth paths further includes a fifth switching device connected between the inductor and the third switching device.

Each of the first to third switching device is connected, in parallel, with a first diode having a first bias direction, and the fifth switching device is connected, in parallel, with a second diode having a second direction which is contrary to the first bias direction.

The fifth switching device becomes a turned-off at the second path while it becomes a turned-on state at the fourth path.

An energy recovering method for a plasma display panel according to another aspect of the present invention includes the steps of (A) charging energy from a source capacitor into an inductor using a first path including the source capacitor and the inductor; and (B) applying energy of the inductor to the panel using a second path which is separated from the source capacitor and includes the inductor and the plasma display panel.

The energy recovering method further includes the steps of (C) charging a voltage from a sustain voltage source into the panel using a third path including the sustain voltage source and the panel; (D) recovering energy charged in the panel to charge the recovered energy into the source capacitor using a fourth path including the panel, the inductor and the source capacitor; and (E) charging a voltage from the ground voltage source into the panel using a fifth path including the ground voltage source and the panel.

Herein, said (A) step includes charging energy from the source capacitor into the inductor through the first path; and shutting off the first path in a state in which energy has been charged in the inductor to thereby derive an inverse voltage into the inductor.

Said (B) step includes charging said inverse voltage derived into the inductor to the panel through the second path.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
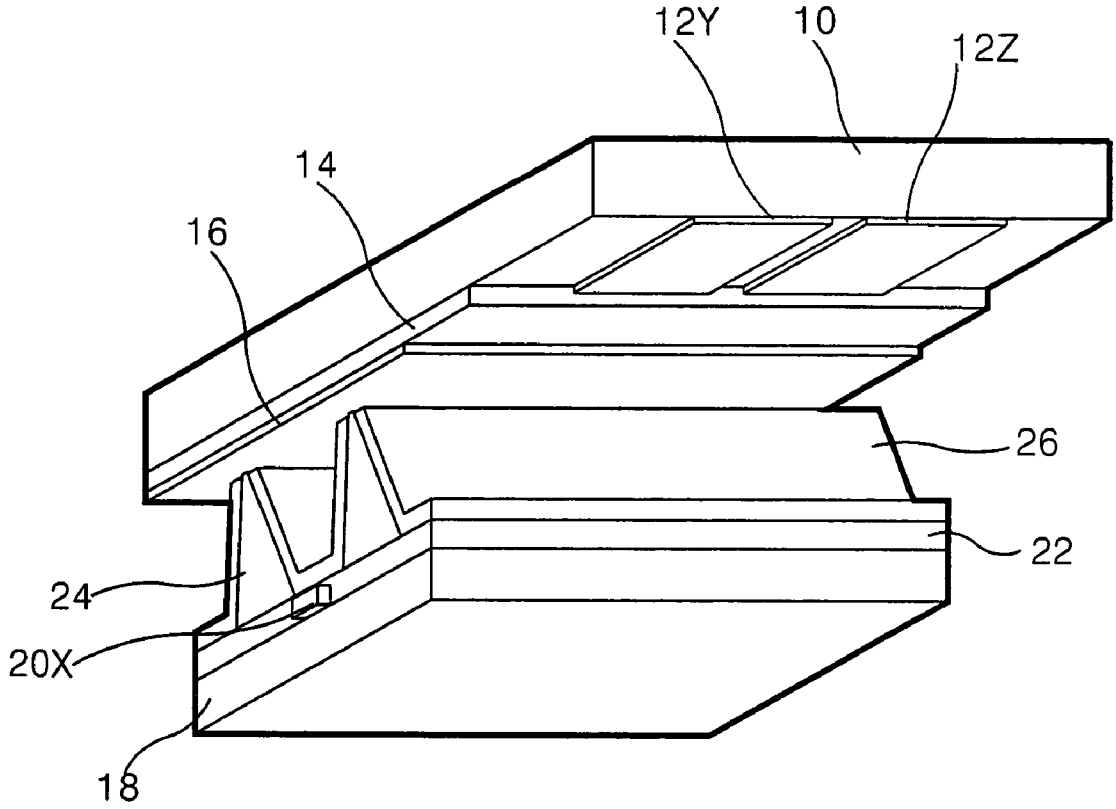
FIG. 1 RELATED ART
FIG. 1 is a perspective view showing a structure of a conventional three-electrode AC surface-discharge plasma display panel.
Figure 2:
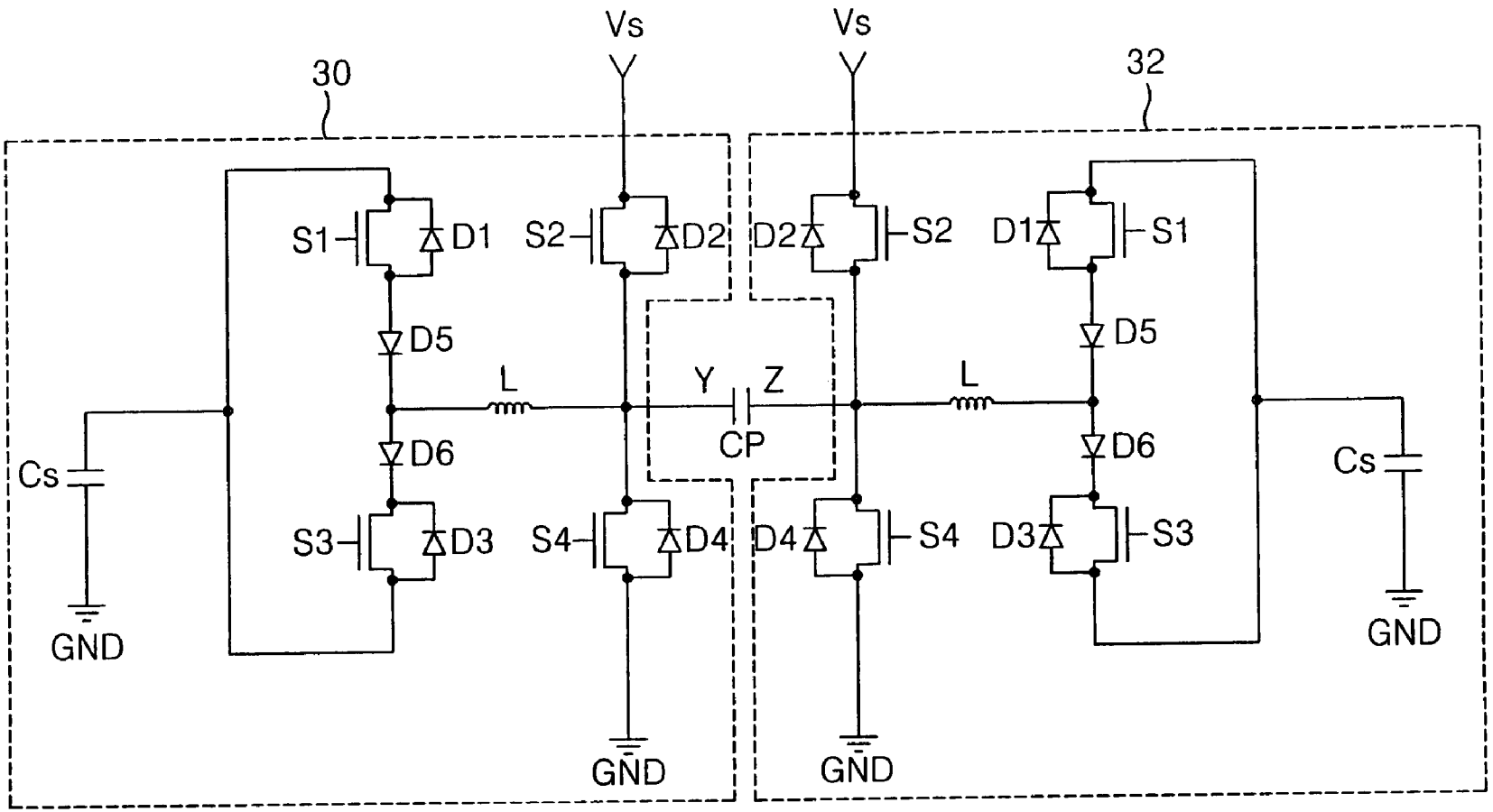
FIG. 2 RELATED ART
FIG. 2 is a circuit diagram of an energy recovering apparatus of the conventional plasma display panel.
Figure 3:
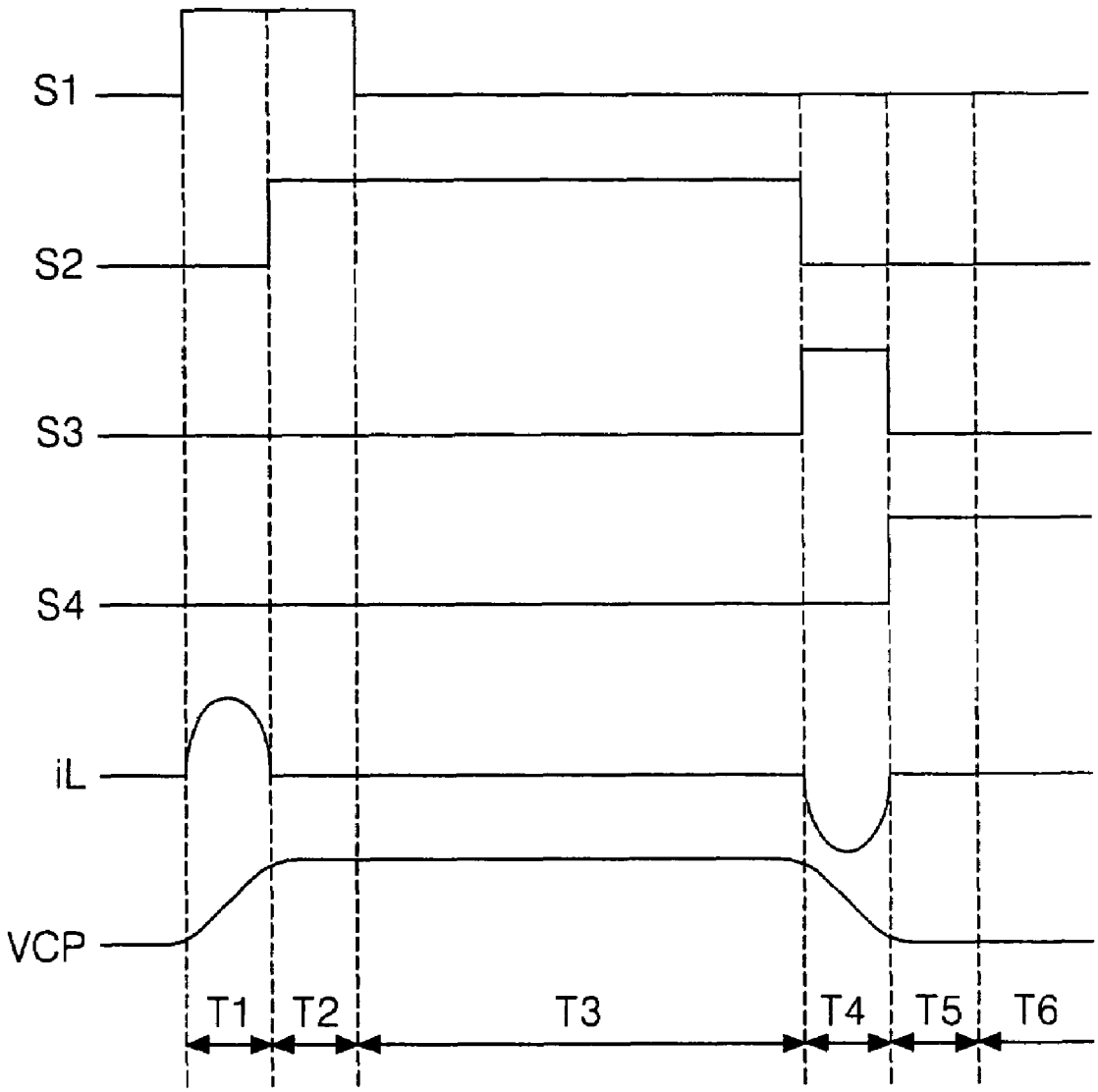
FIG. 3 RELATED ART
FIG. 3 is a timing diagram and a waveform diagram representing an ON/OFF timing of each switch shown in FIG. 2 and an output waveform of the panel capacitor, respectively.
Figure 4:
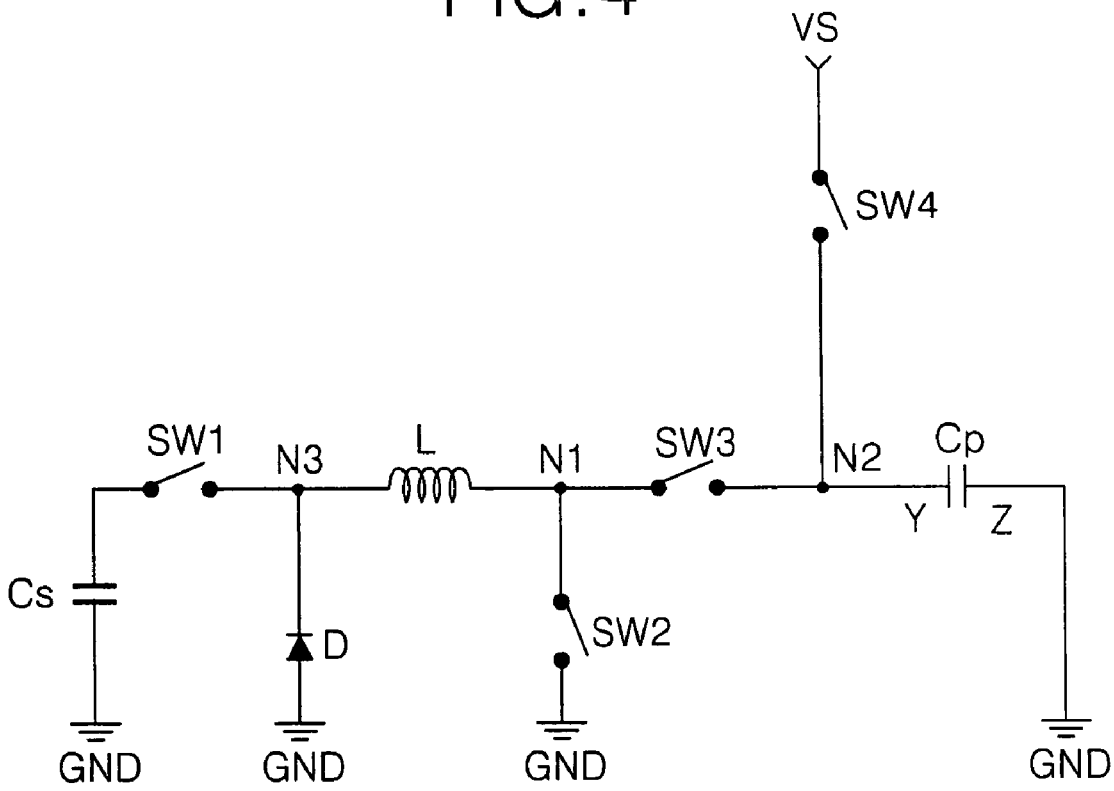
FIG. 4 is a circuit diagram of an energy recovering apparatus of a plasma display panel according to a first embodiment of the present invention.

Referring to FIG. 4, there is shown an energy recovering apparatus of a plasma display panel (PDP) according to the first embodiment of the present invention.

The energy recovering apparatus includes a panel capacitor Cp that is an equivalent capacitance formed between a first electrode Y and a second electrode Z, a source capacitor Cs connected between the panel capacitor Cp and a ground voltage source GND, an inductor L connected between the panel capacitor Cp and the source capacitor Cs, a first switch SW1 connected between the source capacitor Cs and the inductor L, a second switch SW2 connected between a first node N1 positioned between the inductor L and the first electrode Y of the panel capacitor Cp and the ground voltage source GND, a third switch SW3 connected between the first node N1 and the first electrode Y of the panel capacitor Cp, a fourth switch SW4 connected between a second node N2 positioned between the third switch SW3 and the first electrode Y of the panel capacitor Cp and the sustain voltage source Vs, and a diode connected between a third node N3 positioned between the first switch SW1 and the inductor L and the ground voltage source GND.

The sustain voltage source VS generates a sustain voltage VS supplied to the panel capacitor Cp.

The inductor L stores energy from the source capacitor Cs with the aid of a compulsory resonance provided by itself and the source capacitor Cs and thereafter applies the stored energy to the panel capacitor Cp. At this time, energy is not applied to the panel capacitor Cp during a period when energy is stored in the inductor L. As described above, energy is stored in the inductor L by a compulsory resonance between the inductor L and the source capacitor Cs and thereafter the energy stored in the inductor L is applied to the panel capacitor Cp, so that a sustain pulse has a fast rising slope.

Each of the first to fourth switches SW1 to SW4 controls a flow of current.

The diode D shuts off a backward current from the inductor L and the source capacitor Cs. Further, the diode D forms a path for applying energy from the inductor L to the panel capacitor Cp.

Figure 5:
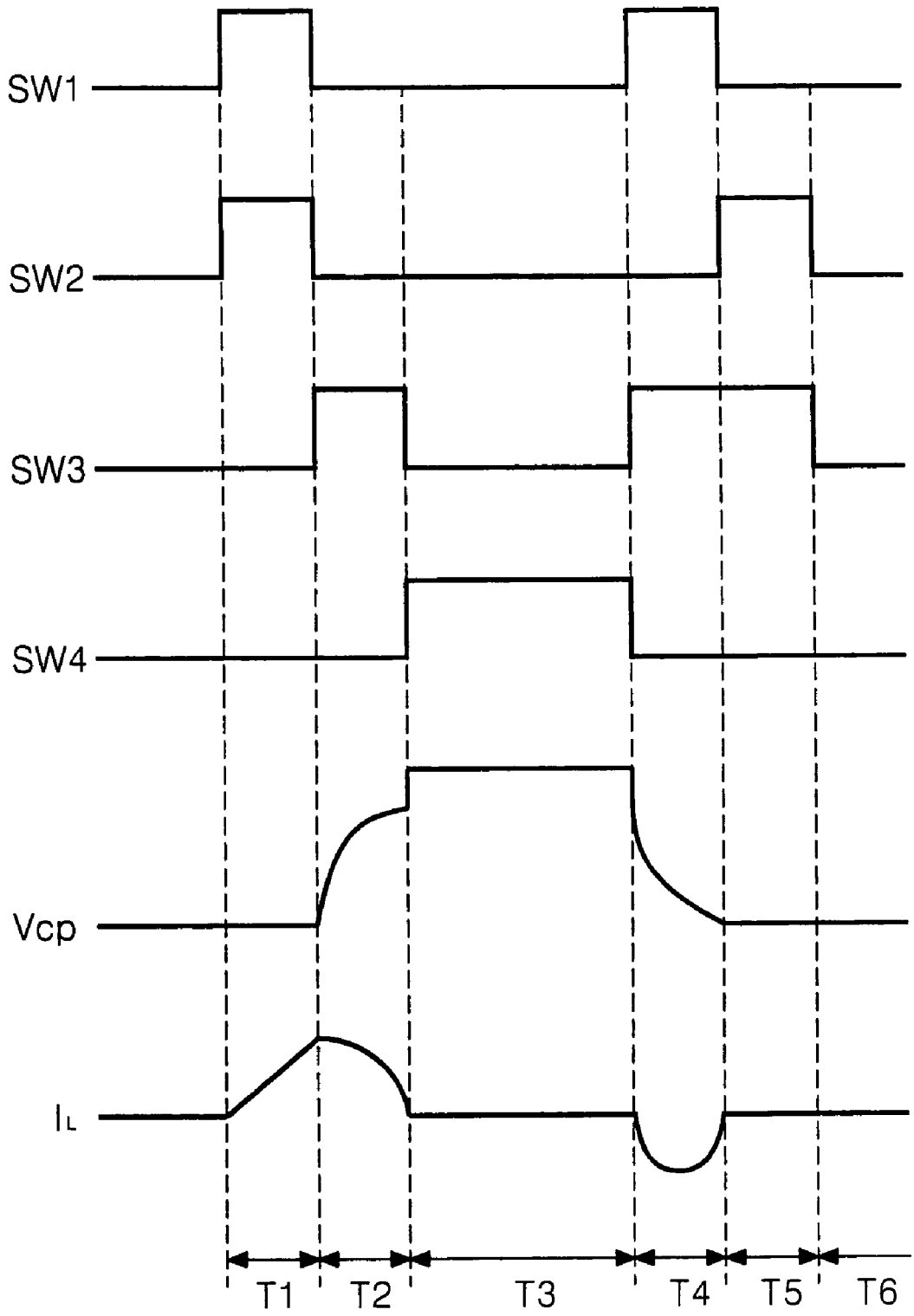
FIG. 5 is a timing diagram and a waveform diagram representing an ON/OFF timing of each switch shown in FIG. 4 and an output waveform of the panel capacitor, respectively.

FIG. 5 is a timing diagram and a waveform diagram representing an ON/OFF timing of each switch and a voltage applied to the panel capacitor in the energy recovering apparatus of the PDP according to the first embodiment of the present invention shown in FIG. 4.

An energy recovering apparatus and method according to the first embodiment of the present invention in FIG. 5 will be described in conjunction with FIG. 4.

An operation procedure of the energy recovering apparatus will be described assuming that 0 volt has been charged in the panel capacitor Cp and a certain voltage has been charged in the source capacitor Cs prior to a T1 period.

Figure 6:
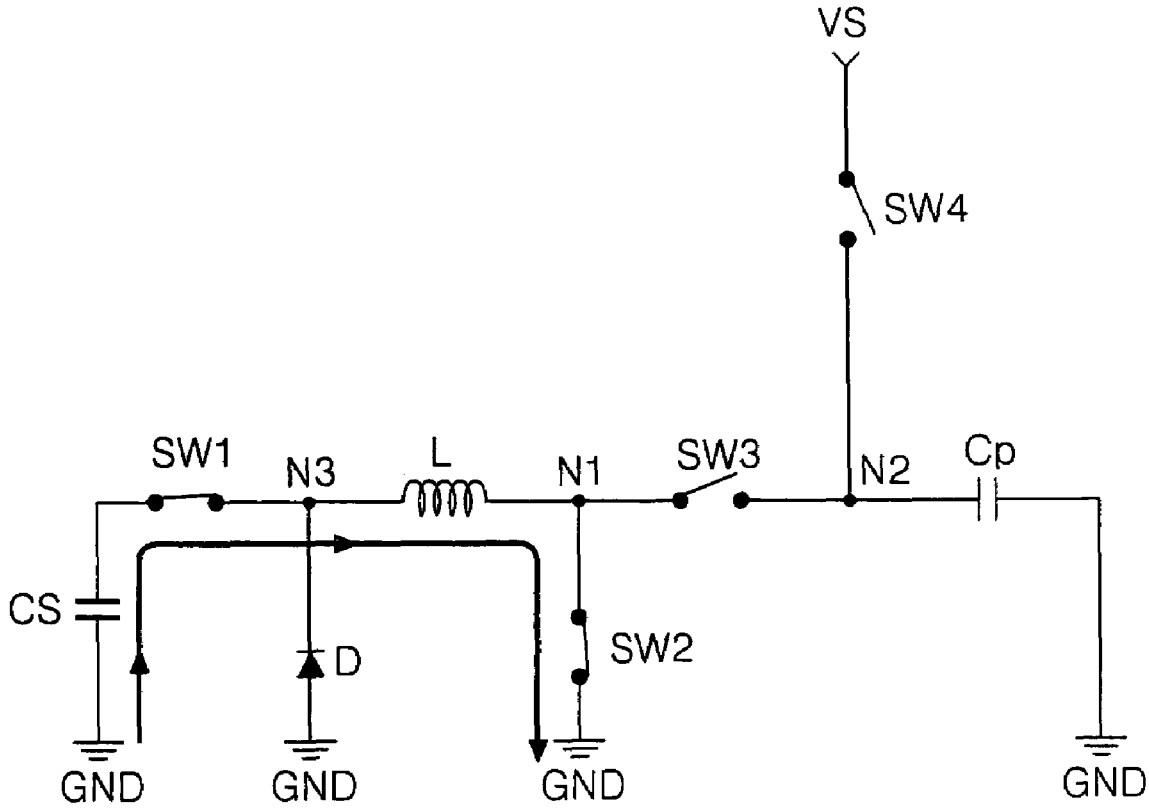
FIG. 6 is a circuit diagram showing an ON/OFF state of each switch and a current path in the T1 interval shown in FIG. 5.

In the T1 period, the first and second switches SW1 and SW2 are turned on, to thereby form a current path extending from the source capacitor Cs, via the first switch SW1, the third node N3, the inductor L, the first node N1 and the second switch SW2, into the ground voltage source GND as shown in FIG. 6. Thus, a serial compulsory resonance circuit between the inductor L and the source capacitor Cs are provided. Accordingly, the inductor L stores energy form the source capacitor Cs. At this time, the energy stored in the inductor L is controlled in accordance with switching timings of the first and second switches SW1 and SW2.

Figure 7:
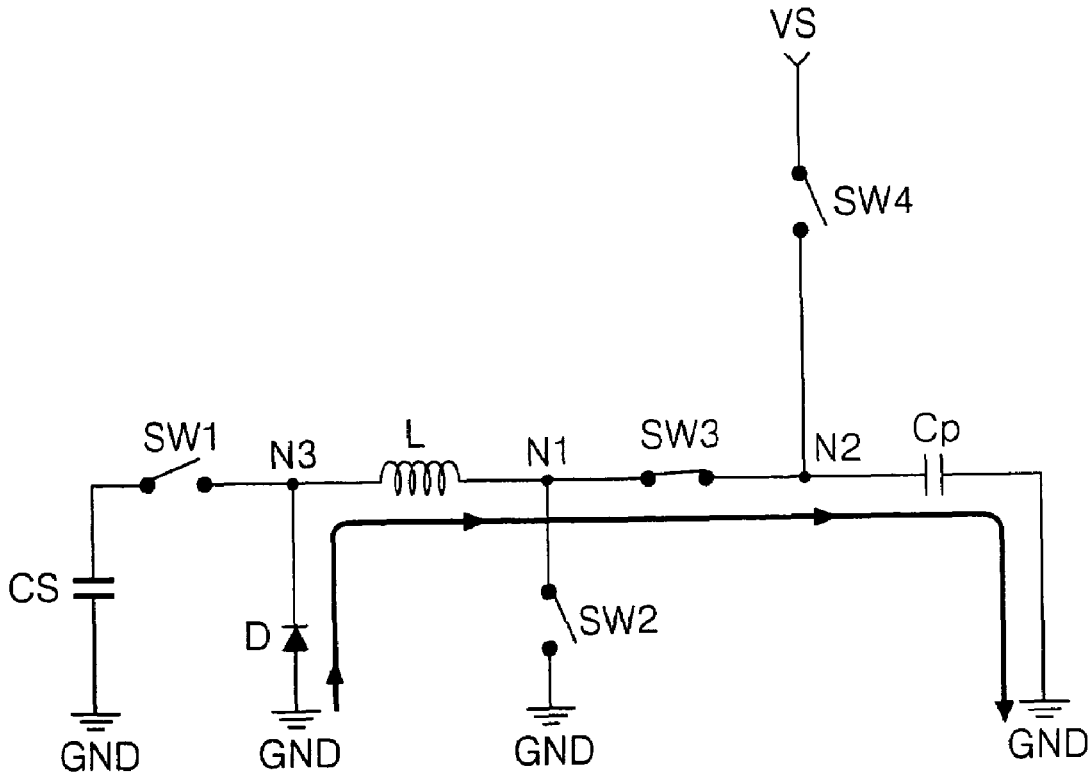
FIG. 7 is a circuit diagram showing an ON/OFF state of each switch and a current path in the T2 interval shown in FIG. 5.

In a T2 period, the first and second switches SW1 and SW2 are turned off while the third switch SW3 is turned on. The third switch SW3 is turned on, to thereby form a current path extending from the ground voltage source GND, via the diode D, the third node N3, the inductor L, the first node N1, the third switch SW3, the second node N2 and the panel capacitor Cp, into the ground voltage source GND as shown in FIG. 7. At this time, an inverse voltage is derived into the inductor L at the instant that the first and second switches SW1 and SW2 are turned off, and the derived inverse voltage is applied to the panel capacitor Cp through said current path. Thus, the panel capacitor Cp charges the inverse voltage from the inductor L. At this time, a voltage Vcp of the panel capacitor Cp rises from 0 volt by the inverse voltage from the inductor L at a fast slope.

Figure 8:
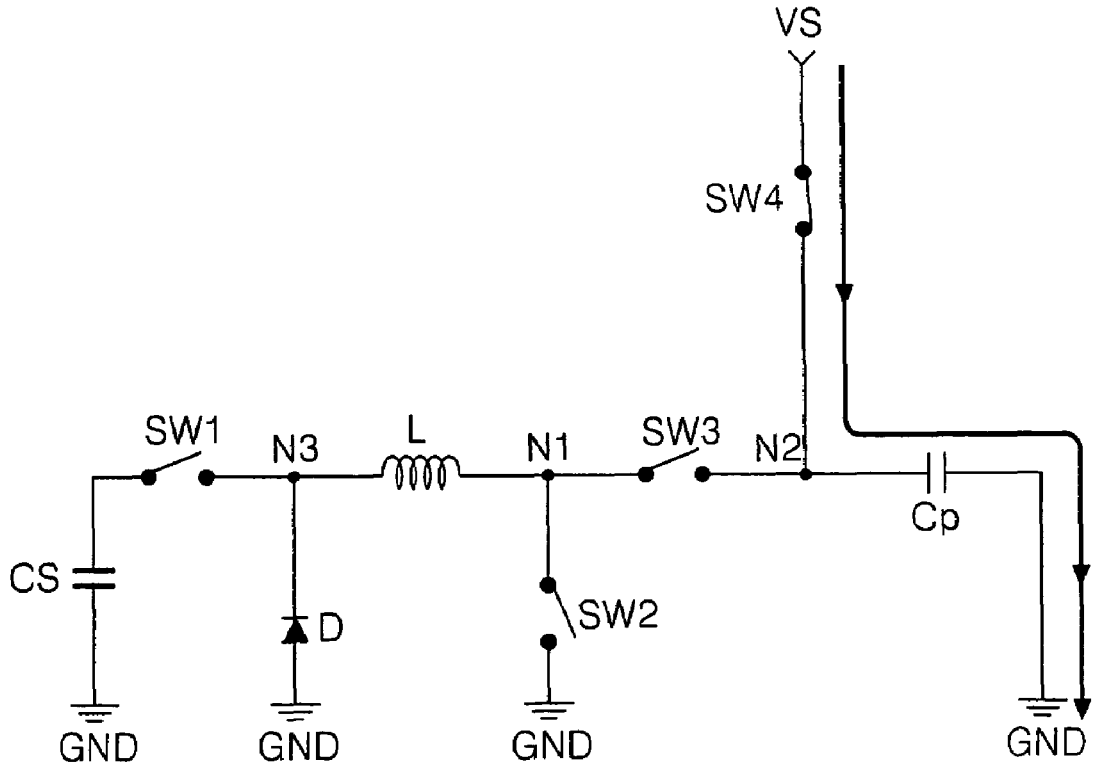
FIG. 8 is a circuit diagram showing an ON/OFF state of each switch and a current path in the T3 interval shown in FIG. 5.

In a T3 period, the third switch SW3 is turned off while the fourth switch SW4 is turned on. The fourth switch SW4 is turned on, to thereby form a current path extending from the sustain voltage source Vs, via the fourth switch SW4, the second node N2 and the panel capacitor Cp, into the ground voltage source GND as shown in FIG. 8. Thus, a sustain voltage Vs from the sustain voltage source Vs is supplied to the first electrode Y of the panel capacitor Cp. A voltage of the sustain voltage source Vs supplied to the first electrode Y of the panel capacitor Cp prevents a voltage of the panel capacitor Cp from falling into less than the sustain voltage source Vs, thereby causing a normal sustain discharge.

Figure 9:
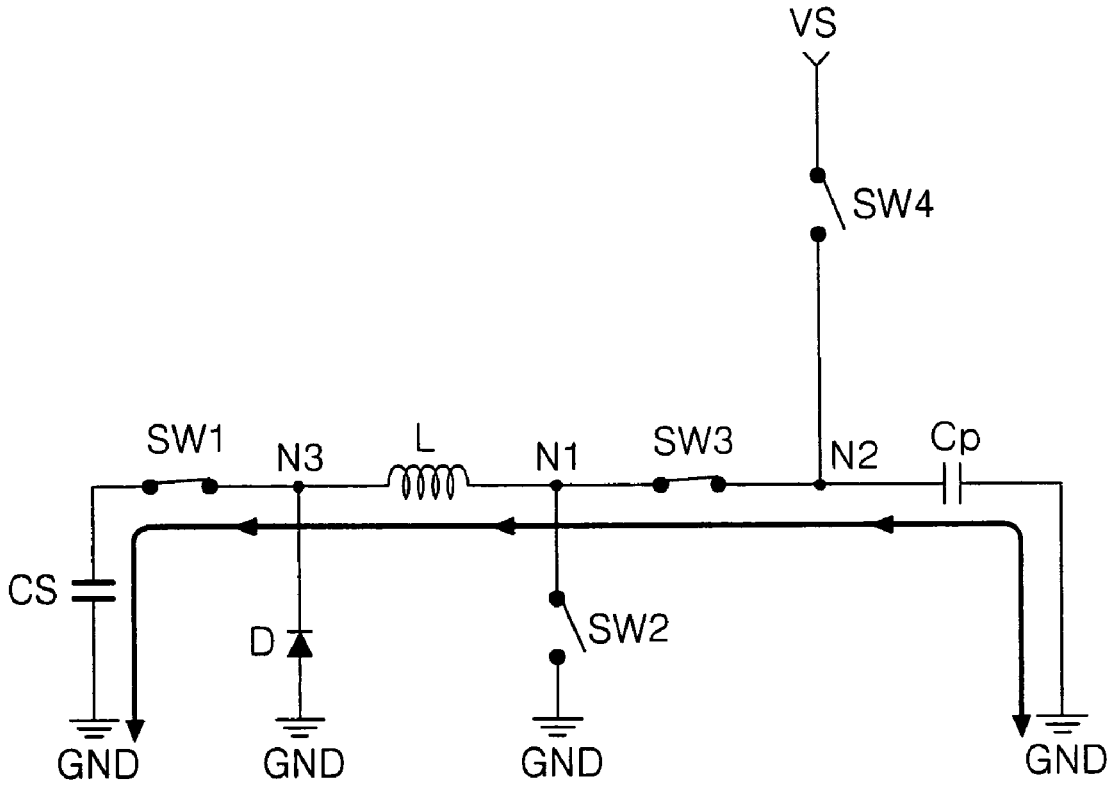
FIG. 9 is a circuit diagram showing an ON/OFF state of each switch and a current path in the T4 interval shown in FIG. 5.

In a T4 period, the fourth switch SW4 is turned off while the first and third switches SW1 and SW3 are turned on. The first and third switches SW1 and SW3 are turned on, to thereby form a current path extending from the panel capacitor Cp, via the second node N2, the third switch SW3, the first node N1, the inductor L, the third node N3, the first switch SW1 and the source capacitor Cs, into the ground voltage source GND as shown in FIG. 9. Thus, a voltage charged in the panel capacitor Cp is recovered into the source capacitor Cs through said current path.

Figure 10:
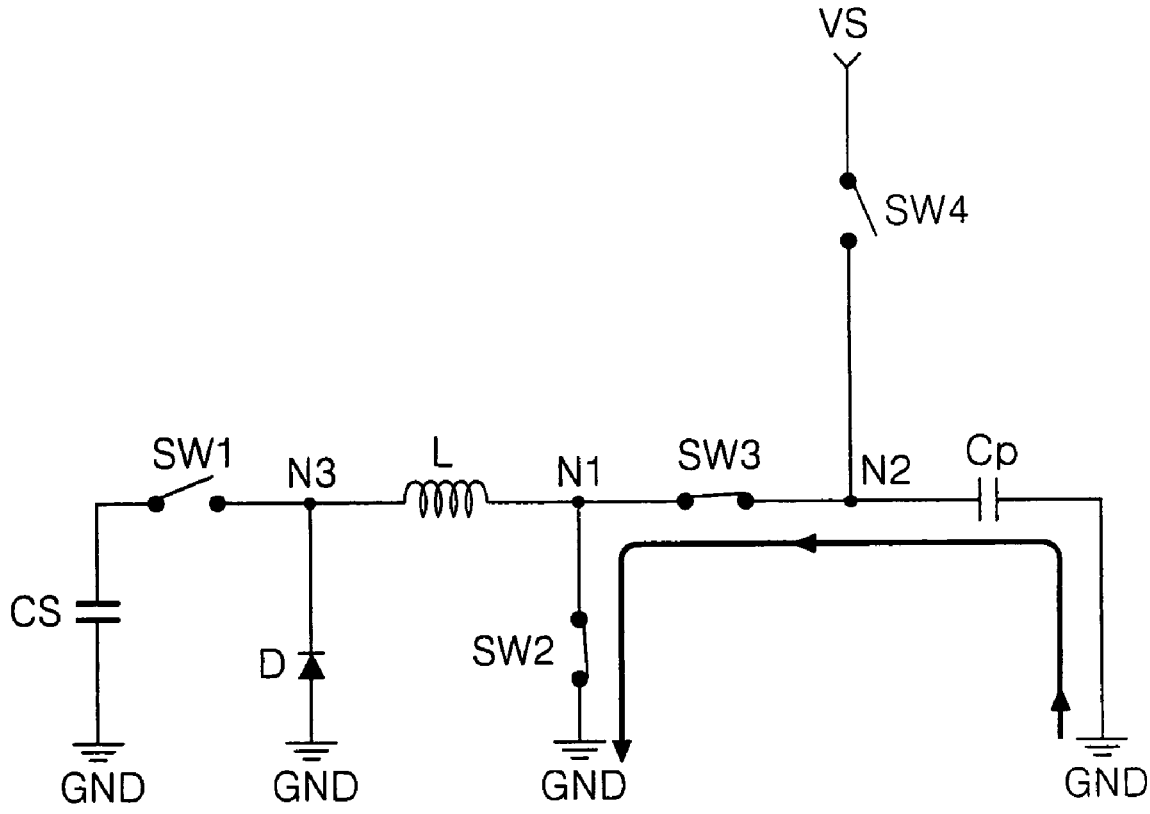
FIG. 10 is a circuit diagram showing an ON/OFF state of each switch and a current path in the T5 interval shown in FIG. 5.

In a T5 period, the first switch SW1 is turned off while the third switch SW3 is kept at a turned-on state and the second switch SW2 is turned on. Thus, a current path extending from the panel capacitor Cp, via the second node N2, the third switch SW3, the first node N1 and the second switch SW2, into the ground voltage source GND as shown in FIG. 10 is formed. Thus, the panel capacitor Cp falls into a ground voltage GND through said current path.

In a T6 period, the T5 state is kept during a predetermined time. In real, a sustain pulse applied to the panel capacitor Cp is provided with periodically repeating the T1 to T6 periods.

As described above, the energy recovering apparatus and method of the PDP according to the first embodiment of the present invention stores energy stored in the source capacitor Cp into the inductor L using a compulsory resonance between the source capacitor Cs and the inductor L and applies the stored energy to the panel capacitor Cp. At this time, energy is not applied to the panel capacitor during a period when the energy stored in the source capacitor Cs is being stored in the inductor L. Thus, the energy recovering apparatus and method of the PDP according to the first embodiment of the present invention charges the energy stored in the inductor L into the panel capacitor by a compulsory resonance, so that it can obtain a fast rising slope of the sustain pulse applied to the panel capacitor Cp, thereby reducing a charge time of energy charged in the panel capacitor Cp. Accordingly, it becomes possible to improve a discharge characteristic owing to the fast rising slope of the sustain pulse.

Figure 11:
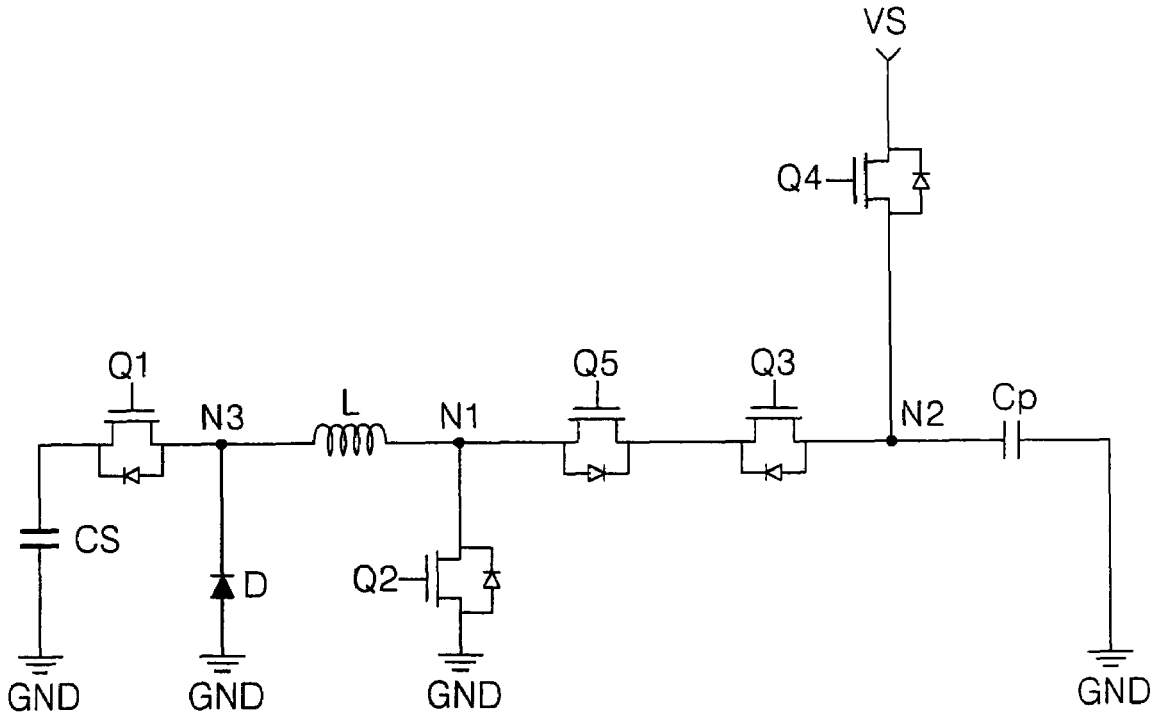
FIG. 11 is a circuit diagram of an energy recovering apparatus of a plasma display panel according to a second embodiment of the present invention.

Referring to FIG. 11, there is shown an energy recovering apparatus of a plasma display panel (PDP) according to the second embodiment of the present invention.

The energy recovering apparatus includes a panel capacitor Cp that is an equivalent capacitance formed between a first electrode Y and a second electrode Z, a source capacitor Cs connected between the panel capacitor Cp and a ground voltage source GND, an inductor L connected between the panel capacitor Cp and the source capacitor Cs, a first switching device Q1 connected between the source capacitor Cs and the inductor L, a second switching device Q2 connected between a first node N1 positioned between the inductor L and the first electrode Y of the panel capacitor Cp and the ground voltage source GND, a third switching device Q3 connected between the first node N1 and the first electrode Y of the panel capacitor Cp, a fourth switching device Q4 connected between a second node N2 positioned between the third switching device Q3 and the first electrode Y of the panel capacitor Cp and the sustain voltage source Vs, a fifth switching device Q5 connected between the third switching device Q3 and the inductor L, and a diode D connected between a third node N3 positioned between the first switching device Q1 and the inductor L and the ground voltage source GND.

The sustain voltage source VS generates a sustain voltage VS supplied to the panel capacitor Cp.

The inductor L stores energy from the source capacitor Cs with the aid of a compulsory resonance provided by itself and the source capacitor Cs and thereafter applies the stored energy to the panel capacitor Cp. At this time, energy is not applied to the panel capacitor Cp during a period when energy is stored in the inductor L. As described above, energy is stored in the inductor L by a compulsory resonance between the inductor L and the source capacitor Cs and thereafter the energy stored in the inductor L is applied to the panel capacitor Cp, so that a sustain pulse has a fast rising slope.

Each of the first to fifth switching devices Q1 to Q5 controls a flow of current. Such first to fifth switching devices Q1 to Q5 are connected, in parallel, to first to fifth diodes, respectively. The first to fifth diodes can be used as internal diodes of the first to fifth switching devices Q1 to Q5. Alternatively, the first to fifth diodes may be used as external diodes thereof. Meanwhile, each of the first to fifth switching devices Q1 to Q5 employs any one of semiconductor switching devices such as a metal oxide semiconductor field-effect transistor (MOSFET), an insulated gate bipolar transistor (IGBT), a silicon-controlled rectifier (SCR), a bipolar junction transistor (BJT) and a high electron mobility transistor (HEMT), etc.

The diode D shuts off a backward current from the inductor L and the source capacitor Cs. Further, the diode D forms a path for applying energy from the inductor L to the panel capacitor Cp.

Figure 12:
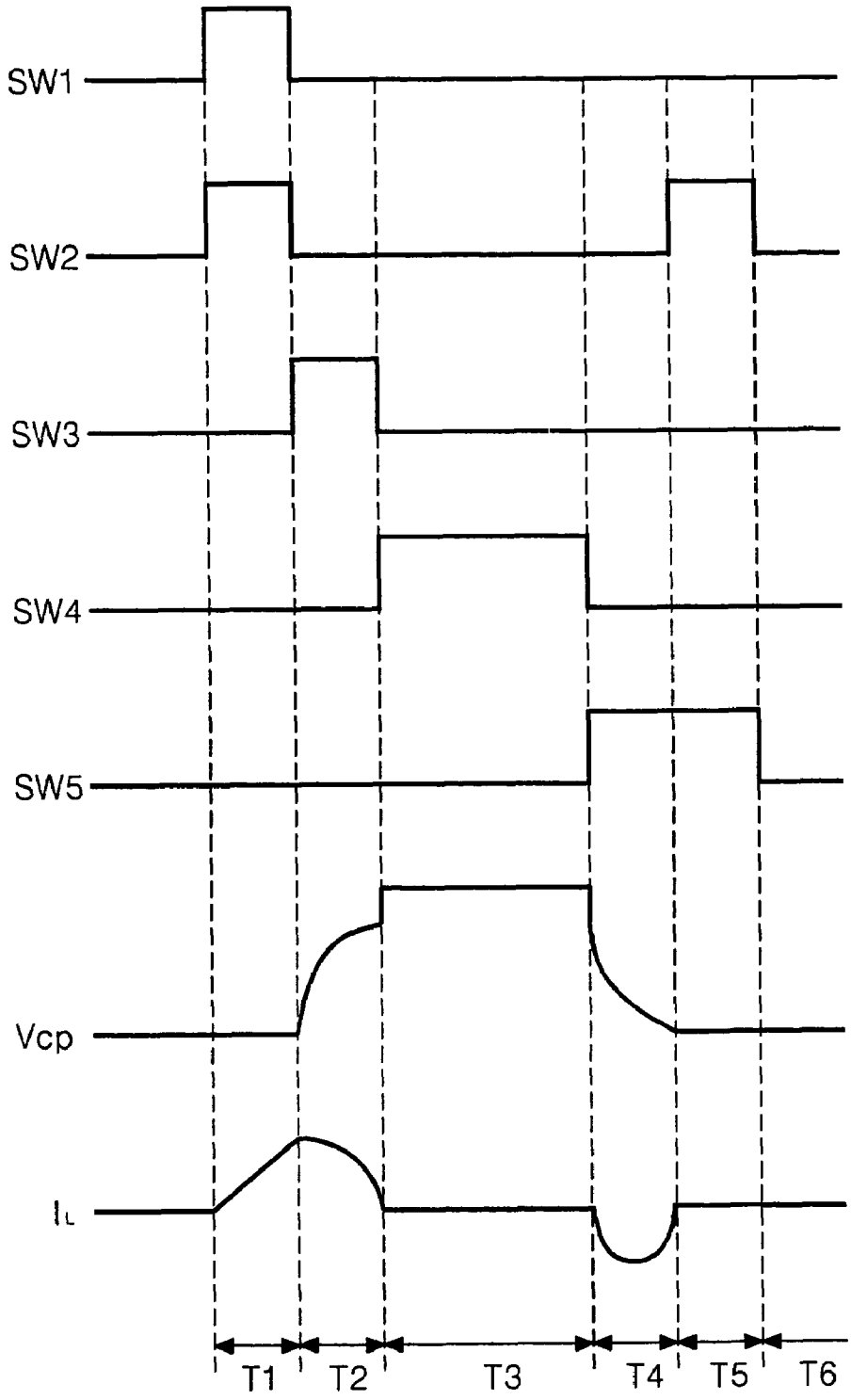
FIG. 12 is a timing diagram and a waveform diagram representing an ON/OFF timing of each switch shown in FIG. 11 and an output waveform of the panel capacitor, respectively.

FIG. 12 is a timing diagram and a waveform diagram representing an ON/OFF timing of each switch and a voltage applied to the panel capacitor in the energy recovering apparatus of the PDP according to the second embodiment of the present invention shown in FIG. 11.

An energy recovering apparatus and method according to the first embodiment of the present invention in FIG. 12 will be described in conjunction with FIG. 11.

An operation procedure of the energy recovering apparatus will be described assuming that 0 volt has been charged in the panel capacitor Cp and a certain voltage has been charged in the source capacitor Cs prior to a T1 period.

Figure 13:
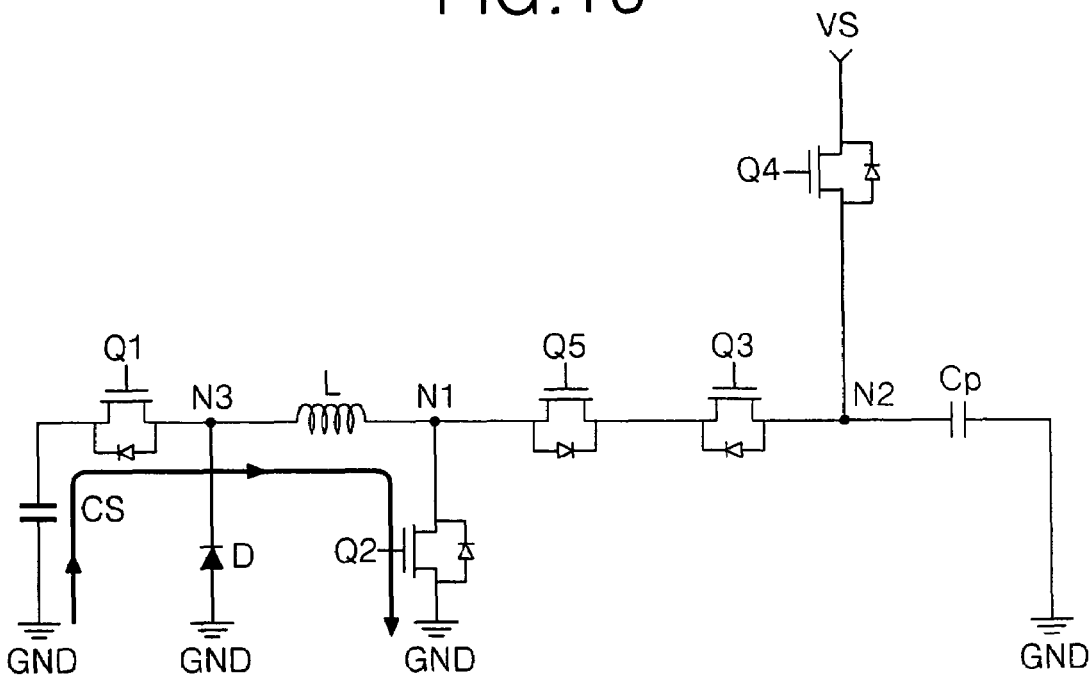
FIG. 13 is a circuit diagram showing an ON/OFF state of each switch and a current path in the T1 interval shown in FIG. 11.

In the T1 period, the first and second switching devices Q1 and Q2 are turned on, to thereby form a current path extending from the source capacitor Cs, via the first switching device Q1, the third node N3, the inductor L, the first node N1 and the second switching device Q2, into the ground voltage source GND as shown in FIG. 13. Thus, a serial compulsory resonance circuit between the inductor L and the source capacitor Cs are provided. Accordingly, the inductor L stores energy form the source capacitor Cs. At this time, the energy stored in the inductor L is controlled in accordance with switching timings of the first and second switching devices Q1 and Q2.

Figure 14:
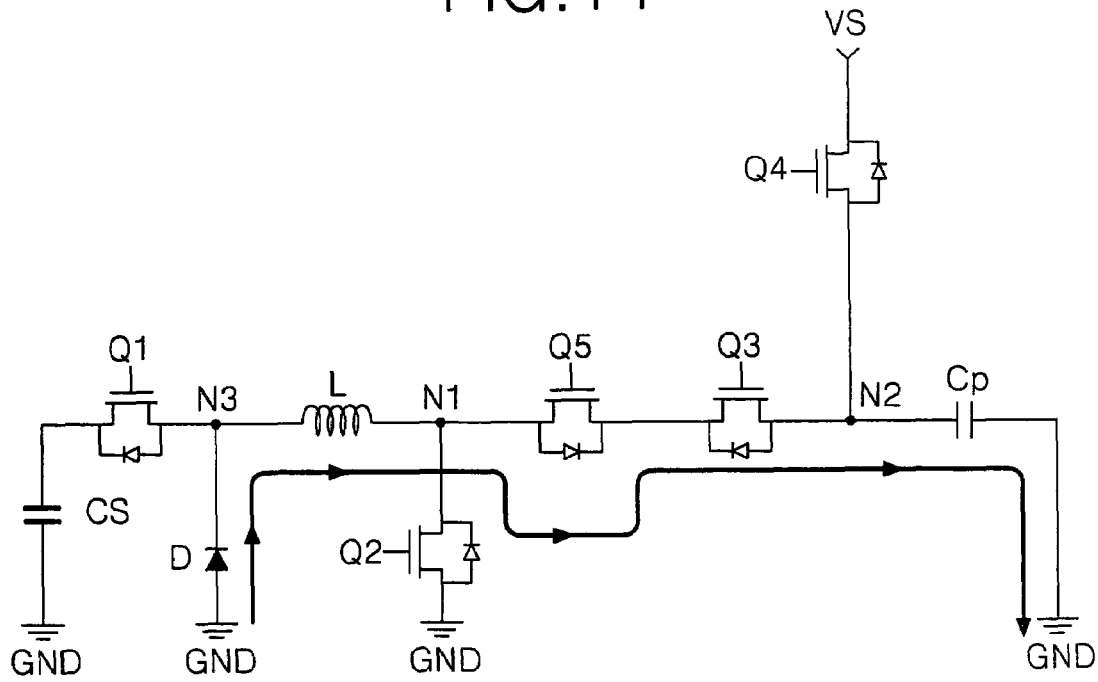
FIG. 14 is a circuit diagram showing an ON/OFF state of each switch and a current path in the T2 interval shown in FIG. 11.

In a T2 period, the first and second switching devices Q1 and Q2 are turned off while the third switching device Q3 is turned on. The third switching device Q3 is turned on, to thereby form a current path extending from the ground voltage source GND, via the diode D, the third node N3, the inductor L, the first node N1, a diode of the fifth switching device Q5, the third switching device Q3, the second node N2 and the panel capacitor Cp, into the ground voltage source GND as shown in FIG. 14. At this time, an inverse voltage is derived into the inductor L at the instant that the first and second switching devices Q1 and Q2 are turned off, and the derived inverse voltage is applied to the panel capacitor Cp through said current path. Thus, the panel capacitor Cp charges the inverse voltage from the inductor L. At this time, a voltage Vcp of the panel capacitor Cp rises from 0 volt by the inverse voltage from the inductor L at a fast slope.

Figure 15:
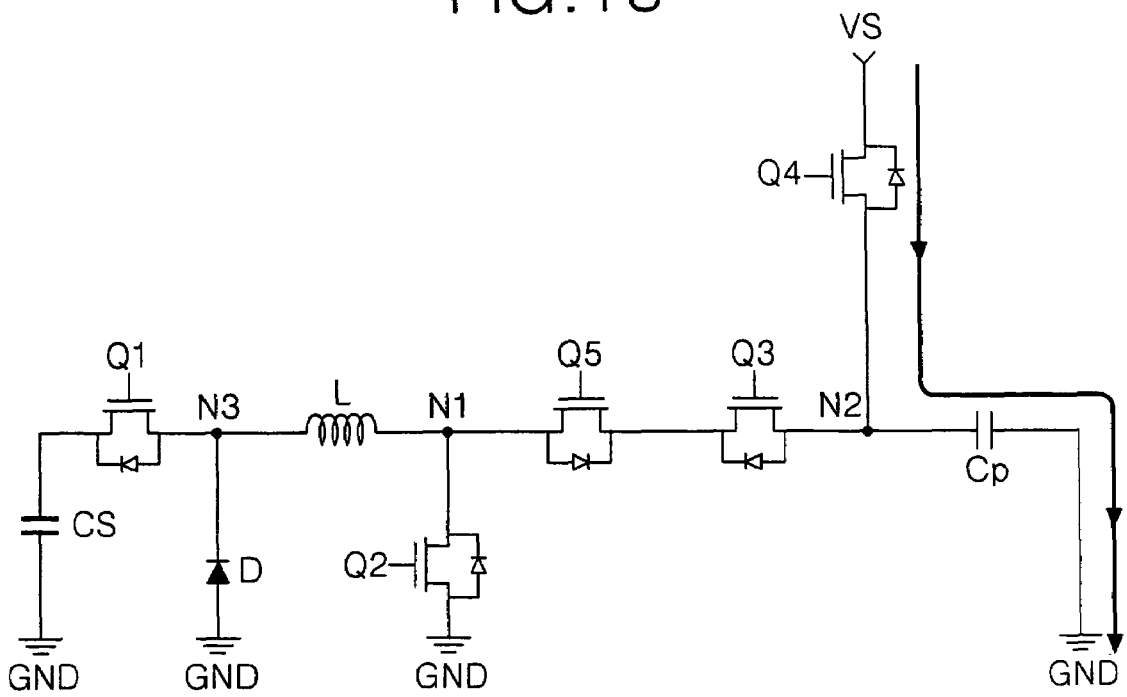
FIG. 15 is a circuit diagram showing an ON/OFF state of each switch and a current path in the T3 interval shown in FIG. 11.

In a T3 period, the third switching device Q3 is turned off while the fourth switching device Q4 is turned on. The fourth switching device Q4 is turned on, to thereby form a current path extending from the sustain voltage source Vs, via the fourth switching device Q4, the second node N2 and the panel capacitor Cp, into the ground voltage source GND as shown in FIG. 15. Thus, a sustain voltage Vs from the sustain voltage source Vs is supplied to the first electrode Y of the panel capacitor Cp. A voltage of the sustain voltage source Vs supplied to the first electrode Y of the panel capacitor Cp prevents a voltage of the panel capacitor Cp from falling into less than the sustain voltage source Vs, thereby causing a normal sustain discharge.

Figure 16:
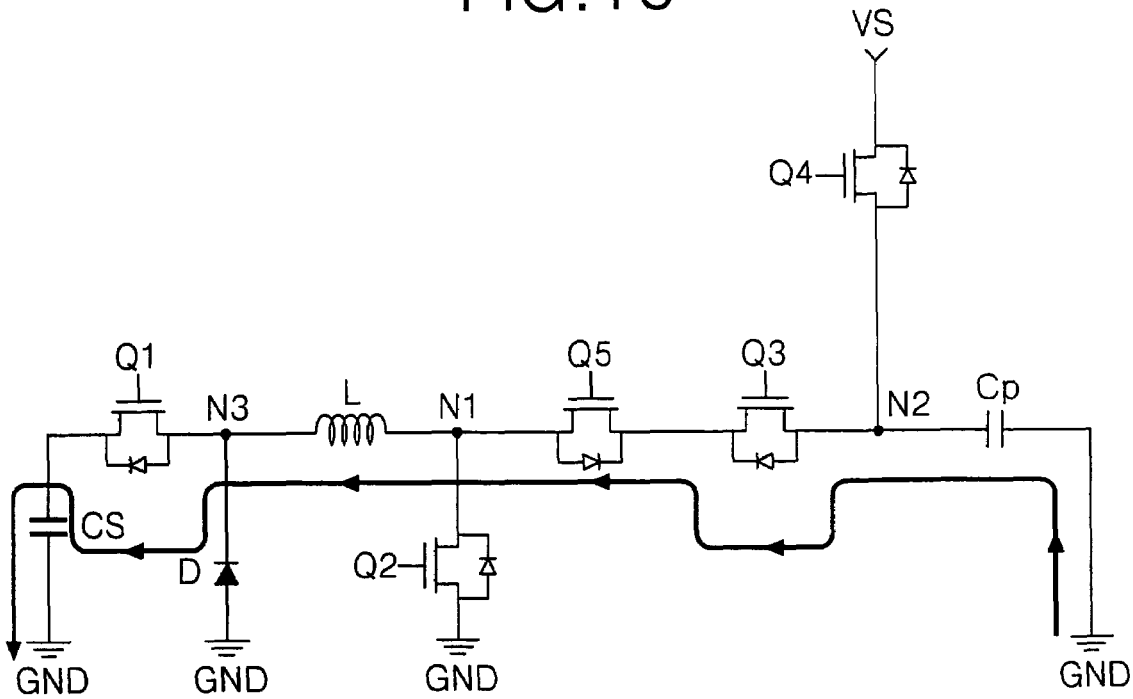
FIG. 16 is a circuit diagram showing an ON/OFF state of each switch and a current path in the T4 interval shown in FIG. 11.

In a T4 period, the fourth switching device Q4 is turned off while the fifth switching device Q5 is turned on. The fifth switching device Q5 is turned on, to thereby form a current path extending from the panel capacitor Cp, via the second node N2, a diode of the third switching device Q3, the fifth switching device Q5, the first node N1, the inductor L, the third node N3, a diode of the first switching device Q1 and the source capacitor Cs, into the ground voltage source GND as shown in FIG. 16. Thus, a voltage charged in the panel capacitor Cp is recovered into the source capacitor Cs through said current path.

Figure 17:
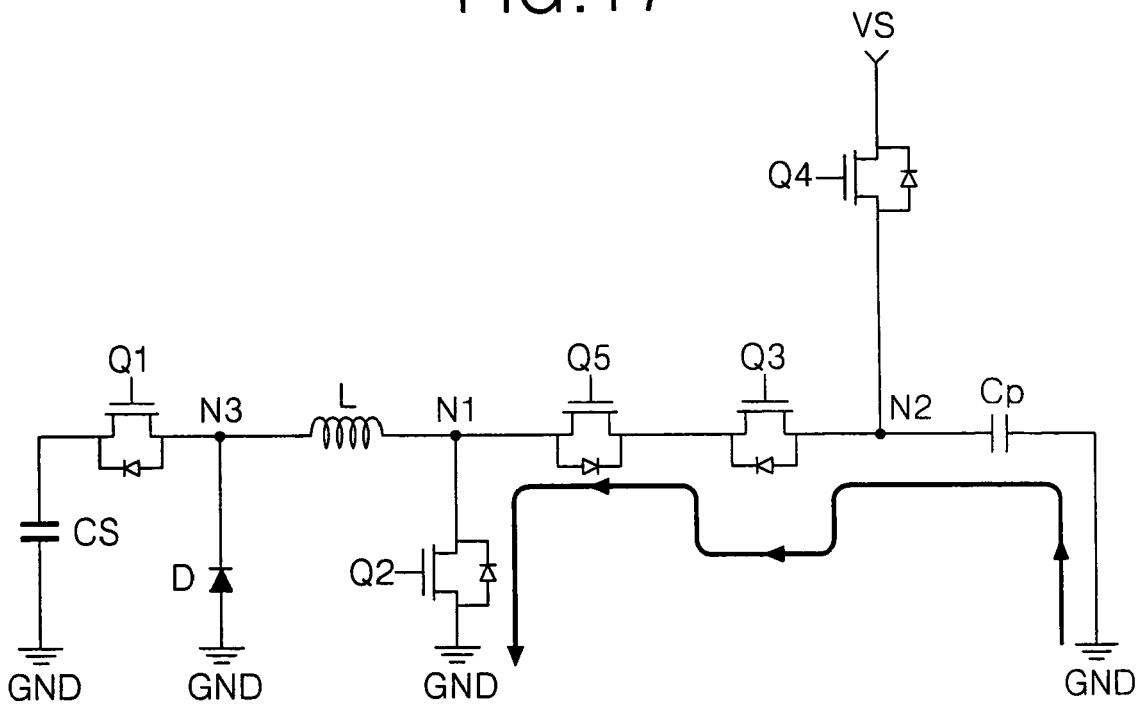
FIG. 17 is a circuit diagram showing an ON/OFF state of each switch and a current path in the T5 interval shown in FIG. 11.

In a T5 period, the fifth switching device Q5 keeps a turned-on state while the second switching device Q2 is turned on. Thus, a current path extending from the panel capacitor Cp, via the second node N2, a diode of the third switching device Q3, the fifth switching device Q5, the first node N1 and the second switching device Q2, into the ground voltage source GND as shown in FIG. 17 is formed. Thus, the panel capacitor Cp falls into a ground voltage GND through said current path.

In a T6 period, the T5 state is kept during a predetermined time. In real, a sustain pulse applied to the panel capacitor Cp is provided with periodically repeating the T1 to T6 periods.

As described above, the energy recovering apparatus and method of the PDP according to the second embodiment of the present invention stores energy stored in the source capacitor Cp into the inductor L using a compulsory resonance between the source capacitor Cs and the inductor L and applies the stored energy to the panel capacitor Cp. At this time, energy is not applied to the panel capacitor during a period when the energy stored in the source capacitor Cs is being stored in the inductor L. Thus, the energy recovering apparatus and method of the PDP according to the first embodiment of the present invention charges the energy stored in the inductor L into the panel capacitor by a compulsory resonance, so that it can obtain a fast rising slope of the sustain pulse applied to the panel capacitor Cp, thereby reducing a charge time of energy charged in the panel capacitor Cp. Accordingly, it becomes possible to improve a discharge characteristic owing to the fast rising slope of the sustain pulse.

As described above, the energy recovering apparatus and method of the PDP according to the present invention stores energy stored in the source capacitor into the inductor using a compulsory resonance between the source capacitor and the inductor and applies the stored energy to the panel capacitor. Thus, the energy recovering apparatus and method of the PDP according to the present invention charges the energy stored in the inductor into the panel capacitor by a compulsory resonance, so that it can obtain a fast rising slope of the sustain pulse applied to the panel capacitor, thereby reducing a charge time of energy charged in the panel capacitor. Accordingly, it becomes possible to improve a discharge characteristic owing to the fast rising slope of the sustain pulse.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An energy recovering apparatus of a plasma display panel, comprising:
- a first path for charging an inductor using energy from a source capacitor; and
- a second path, being separated from the source capacitor, for supplying energy of the inductor to the plasma display panel, wherein the first path includes:
- a first switching device connected between a second terminal of the source capacitor connected to a ground voltage source and a first terminal of the inductor; and
- a second switching device connected between a second terminal of the inductor and the ground voltage source, wherein the first and second switching devices keep a turned-on state during a period when energy from the source capacitor is charged in the inductor through the first path, and shut off the first path in a state in which energy has been charged in the inductor to thereby derive an inverse voltage into the inductor.

2. The energy recovering apparatus as claimed in claim 1, further comprising:
- a third path for charging a voltage from a sustain voltage source into the panel;
- a fourth path for recovering energy charged in the panel to charge the recovered energy, via the inductor, into the source capacitor; and
- a fifth path for charging a voltage from a ground voltage source into the panel.

3. The energy recovering apparatus as claimed in claim 2, wherein the third path includes:
- a fourth switching device connected between the sustain voltage source and the panel.

4. The energy recovering apparatus as claimed in claim 1, wherein the second path includes:
- a third switching device connected between the second terminal of the inductor and the panel; and a diode connected between a node positioned between the first terminal of the inductor and the first switching device and the ground voltage source to form a path for applying energy from the inductor to the panel.

5. The energy recovering apparatus as claimed in claim 4, wherein the third switching device is turned on when the first and second switching devices are turned off, to thereby apply said inverse voltage derived into the inductor to the panel.

6. The energy recovering apparatus as claimed in claim 4, wherein the fourth path includes:

the first switching device and the third switching device.

7. The energy recovering apparatus as claimed in claim 6, wherein each of the second and fourth paths further includes:

a fifth switching device connected between the inductor and the third switching device.

8. The energy recovering apparatus as claimed in claim 7, wherein each of the first to third switching device is connected, in parallel, with a first diode having a first bias direction, and the fifth switching device is connected, in parallel, with a second diode having a second direction which is contrary to the first bias direction.

9. The energy recovering apparatus as claimed in claim 8, wherein the fifth switching device becomes a turned-off at the second path while it becomes a turned-on state at the fourth path.

10. An energy recovering method for a plasma display panel, comprising:

(A) charging energy from a source capacitor into an inductor using a first path by enabling a first switch coupled between the source capacitor and the inductor and by enabling a second switch coupled between the inductor and a prescribed potential; and (B) applying energy of the inductor to the panel using a second path that is separated from the source capacitor by disabling the first switch coupled between the source capacitor and the inductor and by disabling the second switch coupled between the inductor and the prescribed potential.

11. The energy recovering method as claimed in claim 10, further comprising:

(C) charging a voltage from a sustain voltage source into the panel using a third path including the sustain voltage source and the panel;

(D) recovering energy charged in the panel to charge the recovered energy into the source capacitor using a fourth path including the panel, the inductor and the source capacitor; and (E) charging a voltage from the ground voltage source into the panel using a fifth path including the ground voltage source and the panel.

12. The energy recovering method as claimed in claim 10, wherein charging energy from the source capacitor into the inductor includes:

charging energy from the source capacitor into the inductor through the first path; and shutting off the first path in a state in which energy has been charged in the inductor to thereby derive an inverse voltage into the inductor.

13. The energy recovering method as claimed in claim 12, wherein applying energy of the inductor to the panel includes:

charging said inverse voltage derived into the inductor to the panel through the second path.

14. An energy recovering apparatus for a plasma display panel having a panel capacitance, comprising:

a first node for coupling to the panel capacitance;

a second node for coupling to a prescribed potential;

an inductor coupled to the first node and the second node;

a first switching circuit coupled to the second node;

a capacitor coupled to the first switching circuit and the prescribed potential; and a second switching circuit coupled to the first node and to the prescribed potential, wherein during a first prescribed period of time, the first and second switching circuits allow transfer of energy between the capacitor and the inductor through a first electrically conductive path, and during a second prescribed period of time, the first and second switching circuits allow transfer of energy stored in the inductor to the first node through a second electrically conductive path which excludes the capacitor.

15. The energy recovery apparatus of claim 14, further comprising:

a third node coupled to the panel capacitance;

a third switching circuit, coupled between the first node and the third node, to allow transfer of the energy stored in the inductor to the panel capacitance during the second prescribed period of time.

16. The energy recovery apparatus of claim 15, further comprising:

a fourth switching circuit coupled to the third node and for coupling to a prescribed voltage source, wherein during a third prescribed period of time, the third switching circuit allows clamping of the panel capacitance to a voltage of the prescribed voltage source.

17. The energy recovery apparatus of claim 16, wherein during a fourth prescribed period of time, the first and third switching circuits allow transfer of charges stored in the panel capacitance to the capacitor through the inductor, and the second and fourth switching circuits prevent coupling of the panel capacitance to the prescribed potential and the prescribed voltage source.

18. The energy recovery apparatus of claim 17, wherein during a fifth prescribed period of time, the second and third switching circuits allow clamping of the panel capacitance to the prescribed potential.

19. The energy recovery apparatus of claim 18, further comprising a diode coupled to the second node and the prescribed potential.

20. The energy recovery apparatus of claim 19, wherein each of the first, second, third and fourth switching circuits comprises a transistor, the transistor being one of a field effect transistor, an insulated gate bipolar transistor, a silicon controlled rectifier, a bipolar junction transistor, and high electron mobility transistor, and the prescribed potential is a ground potential.

21. The energy recovery apparatus of claim 19, wherein each of the first, second and fourth switching circuits comprises a transistor and a diode connected in parallel, and the third switching circuit comprises a first transistor coupled in series to a second transistor, and a first diode coupled in parallel with the first transistor and a second diode coupled in parallel to the second transistor, the first diode allowing current flow which is opposite from the second diode, the transistors being one of field effect transistors, insulated gate bipolar transistors, a silicon controlled rectifiers, a bipolar junction transistors, and high electron mobility transistors, and the prescribed potential is a ground potential.

22. The energy recovering apparatus of claim 14, further comprising a diode coupled to the second node and the prescribed potential.

* * * * *